US009975226B2

(12) United States Patent
Wei et al.

(10) Patent No.: US 9,975,226 B2
(45) Date of Patent: May 22, 2018

(54) ELECTRIC TOOL FOR OUTPUTTING TORQUE

(71) Applicant: CHERVON INTELLECTUAL PROPERTY LIMITED, Road Town (VG)

(72) Inventors: Gan Wei, Nanjing (CN); Wu Chen, Nanjing (CN)

(73) Assignee: Chervon (HK) Limited, Wanchai (HK)

( * ) Notice: Subject to any disclaimer, the term of this patent is extended or adjusted under 35 U.S.C. 154(b) by 876 days.

(21) Appl. No.: 14/526,717

(22) Filed: Oct. 29, 2014

(65) Prior Publication Data

US 2015/0122525 A1 May 7, 2015

(30) Foreign Application Priority Data

Nov. 4, 2013 (CN) ..... 2013 1 0537379

(51) Int. Cl.
*B25B 21/02* (2006.01)
*B25B 23/14* (2006.01)

(52) U.S. Cl.
CPC ..... *B25B 23/1405* (2013.01); *B25B 21/026* (2013.01)

(58) Field of Classification Search
CPC ... B25B 21/02; B25B 23/1405; B25B 21/023; B25B 21/026
USPC ..... 173/179, 4, 5, 176
See application file for complete search history.

(56) References Cited

U.S. PATENT DOCUMENTS 3,904,305 A * 9/1975 Boyd ..... F01B 25/16 137/58
4,222,702 A * 9/1980 Rush ..... F01D 15/062 173/179
4,359,107 A * 11/1982 Smith ..... B25B 23/145 173/179
5,740,892 A * 4/1998 Huang ..... B25B 21/00 173/179
6,186,247 B1 * 2/2001 Wang ..... B25B 21/00 173/176
8,528,658 B2 * 9/2013 Roehm ..... B23B 31/1207 173/176

* cited by examiner

*Primary Examiner* — Gloria R Weeks
(74) *Attorney, Agent, or Firm* — Greenberg Traurig, LLP

(57) ABSTRACT

An electric tool for outputting torque includes a housing and a motor disposed in the housing, a rotatable base configured to be driven by the motor to rotate about a first axis, at least one impact block rotatably connected to the rotatable base, an output shaft rotatably connected in the housing and configured to rotate about the first axis under intermittent impact of the impact block, a locking member which, when at a first position, locks the impact block to prevent it from impacting on the output shaft and which, when at a second position, releases the impact block to allow it to rotate freely, a biasing assembly for biasing the locking member to the first position, a regulating assembly for regulating a biasing degree exerted by the biasing assembly on the locking member, and a control assembly operable by the user from outside the housing to control the regulating assembly. The locking member is disposed at least partially in the rotatable base.

13 Claims, 10 Drawing Sheets

ELECTRIC TOOL FOR OUTPUTTING TORQUE

RELATED APPLICATION INFORMATION

This application claims the benefit of CN 201310537379.5, filed on Nov. 4, 2013, the disclosure of which is incorporated herein by reference in its entirety.

BACKGROUND

The subject disclosure generally relates to electric tools, and more specifically, to an electric tool for outputting torque.

Electric tools for outputting torque include two types: one type is for continuously transmitting torque and the other type is for outputting torque in an intermittent impact manner, wherein a typical electric tool among the latter type is an impact wrench. In the impact wrench, there is one type comprising a mechanism for achieving a circumferential impact by using a centrifugal force. By using a centrifugal force generated upon high-speed rotation, an impact hammer is enabled to swing about a metal pin against the action of a spring latch so as to impact with an output shaft. Such a product is advantageous in that the impact torque is associated with a rotation speed of a base when the impact hammer swings, and in that when a pre-pressure of the spring latch is very large, the rotation speed of the base is very high so that the impact action occurs and a very large impact torque can be generated. A drawback of such a product lies in that once the pre-pressure of the spring latch is preset, the machine will always impact at a certain speed that the user cannot adjust. In the case that a small torque is needed, the workpiece to be fixed might be damaged by using this machine.

SUMMARY

To overcome the drawbacks in the prior art, the following generally describes an electric tool whose output impact torque may be adjusted as desired during use.

To achieve the above object, a described tool generally includes a housing and a motor disposed in the housing; a rotatable base configured to be driven by the motor to rotate about a first axis; at least an impact block pivotally connected to the rotatable base; an output shaft rotatably connected in the housing and configured to rotate about the first axis under intermittent impact of the impact block; a locking member, when at a first position, configured to lock the impact block to prevent it from impacting on the output shaft, and when at a second position, to release the impact block to allow it to rotate freely; a biasing assembly for biasing the locking member to the first position; a regulating assembly for regulating a biasing degree exerted by the biasing assembly to the locking member; and a control assembly operable by the user from outside to control the regulating assembly; wherein the locking member is disposed at least partially in the rotatable base.

Furthermore, the electric tool may include a transmission member directly or indirectly driven by the motor to rotate about the first axis, and a clutch assembly transmitting motion between the transmission member and the rotatable base when in a first state and releasing transmission when in a second state.

Furthermore, the transmission member may be formed with a transmission end face on one side facing towards the rotatable base, wherein the transmission end face is formed with more than two torque grooves uniformly distributed in the circumferential direction; an wherein the end face of the rotatable base facing towards the transmission member has at least a receiving groove corresponding to the torque groove and the clutch assembly may include a clutch member movably disposed in the receiving groove and able to be partially embedded into the torque groove with a clutch elastic member disposed in the receiving groove and biasing the clutch member towards the transmission member.

Furthermore, the impact block may be provided with a locking recess and the rotatable base may be provided with a locking through hole which receives the locking member to allow it to move in a direction parallel to the first axis, to be partially embedded into the locking recess when at the first position adjacent to the impact block so as to block rotation of the impact block, and to retreat out of the locking recess when at the second position away from the impact block.

Furthermore, the rotatable base may include a front frame, a base and at least a connecting pillar disposed therebetween and connecting them as a whole, the impact block being disposed between the front frame and the base.

Furthermore, the base may be disposed on a side adjacent to the biasing assembly and the front frame may be disposed on a side adjacent to the output shaft with the front frame, the connecting pillar and the base being distributed in turn in a direction parallel to the first axis with the base being provided with the locking through hole.

Furthermore, the biasing assembly may include an elastic element or magnetic body disposed in the locking through hole and configured to bias the locking member towards the impact block, and the regulating assembly may include a press plate slidably connected to the rotatable base in a direction parallel to the first axis and configured to rotate synchronously with it; wherein the press plate is formed with at least a press rod; the press rod partially extends into the locking through hole and contacts with one end of the elastic element, the other end of the elastic element contacts with the locking member, or the press rod partially extends into the locking through hole and being fixed with the magnetic body at its end.

Furthermore, the control assembly may include an operation ring configured to rotate a preset angle about the first axis, an inner ring configured to move in a direction parallel to the first axis when the operation ring rotates, a pushing plate which is rotatably connected to the press plate with the first axis as an axis, and at least a link disposed between the inner ring and the pushing plate.

Furthermore, the operation ring may be disposed at an outer periphery of the inner ring and its inside may be provided with more than one inner edge protrusion with the outside of the inner ring being provided with an inclined step matching with the inner edge protrusion.

Furthermore, a rotation axis of the impact block may be parallel to the first axis.

Furthermore, the number of the impact block may be two, and the impact blocks may be in mirror symmetry and respectively provided on both sides of a first plane where the first axis lies.

Furthermore, the biasing assembly may include an electromagnetic body capable of attracting or expelling the locking member, the regulating assembly may include a power supply module for powering the electromagnetic body, and the control assembly may include a magnetic control circuit board capable of controlling the power supply module.

Furthermore, the electric tool may include a speed counting element fixedly disposed on the rotatable base and being revolvable about the first axis and a detecting means capable of detecting a rotation speed of the speed counting element with the detecting assembly being disposed in the housing.

Furthermore, the electric tool may include a main control circuit board capable of receiving rotation speed data fed back from the detecting means and controlling the rotation speed of the motor when the rotation speed reaches a preset value.

Advantages of the described electric tool are as follows: the regulating assembly and the control assembly enable the user to regulate the biasing degree exerted by the biasing assembly to the locking member according to needs, thereby allowing the user to regulate a speed threshold when the impact block is thrown out centrifugally so as to achieve the purpose of controlling the impact torque; the detecting means and main control circuit can be used to detect and control the rotation speed to further improve output precision degree of the impact torque; and the clutch assembly, upon occurrence of the impact, can also effectively protect the motor and prolong the service life of the motor.

DETAILED DESCRIPTION

Figure 1:
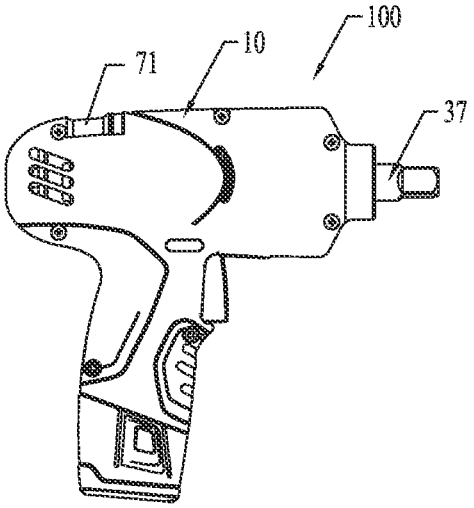
FIG. 1 is a schematic view of the external structure of an exemplary electric tool constructed according to the description which follows.

Referring to FIGS. 1-5, an exemplary electric tool 100 for outputting torque mainly comprises: a housing 10, a motor 20 and a transmission mechanism 30 driven by the motor 20 to achieve a torque output.

An exemplary transmission mechanism 30 comprises: a gearbox 31, an output member 32, a transmission member 33, a clutch assembly 34, a rotatable base 35, at least an impact block 36 and an output shaft 37.

A rotation shaft of the motor 20 applies an input torque to the gearbox 31, and an output end of the gearbox 31 provides an output torque via an output member 32 connected thereto, wherein the output member 32 performs torque transmission in a way that protrusions 321 axially extending from and circumferentially arranged on the output member are embedded into transmission grooves 331 formed on the transmission member 33. The transmission member 33 transmits the torque to the rotatable base 35 to make it rotate about a first axis A. The impact block 36 is pivotally connected to the rotatable base 35. When a rotation speed of the rotatable base 35 reaches a certain threshold, the impact block 36 can make an impact torque on the output shaft 37 and thereby make the output shaft 37 rotate. In this solution, the output member 32, the transmission member 33, the rotatable base 35 and the output shaft 37 all rotate about the first axis A, thus, unless otherwise particularly illustrated, any axial direction, radial direction and circumferential direction that are mentioned in the present application take the first axis A as a reference. Certainly, other torque transmission structures may also be used between the rotation shaft of the motor 20 and the transmission member 33, which may be implemented by those skilled in the art according to specific situations, and which will not be detailed herein.

In the transmission mechanism 30, to achieve a torque transmission between the transmission member 33 and the rotatable base 35, the output member 32 may be directly engaged with the transmission member 33. However, when the rotatable base 35 impacts on the output shaft 37, and then, in turn, due to a counter-acting force, impacts on the transmission member 33 in a direction opposite to a rotation direction of the motor 20, the service life of the motor 20 may be negatively affected.

Figure 5:
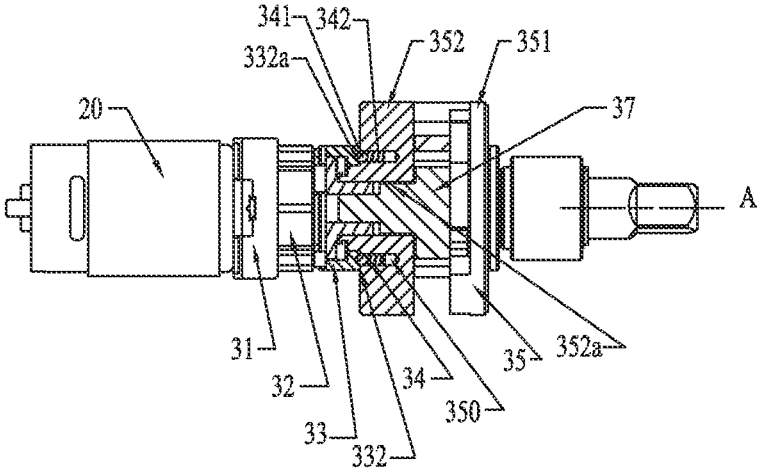
FIG. 5 is a partial cross-sectional view of the structures shown in FIG. 4.
Figure 6:
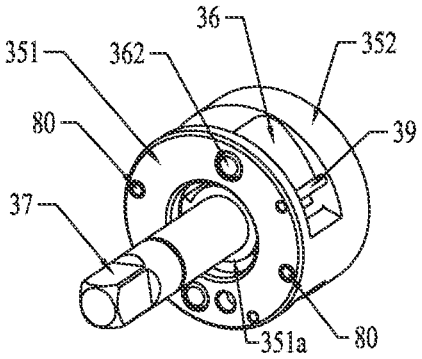
FIG. 6 is a schematic view of partial structures at an exemplary rotatable base in the tool as shown in FIG. 1.
Figure 7:
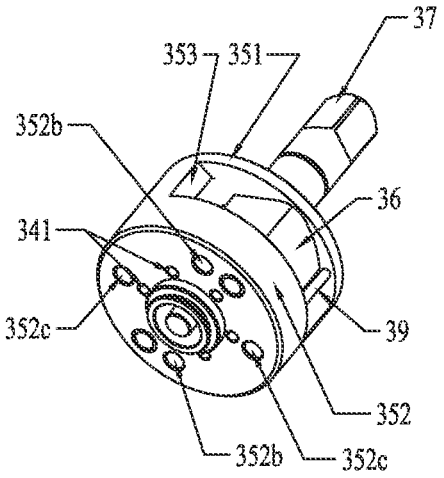
FIG. 7 is a schematic view of the structure shown in FIG. 6 from another view angle.
Figure 8:
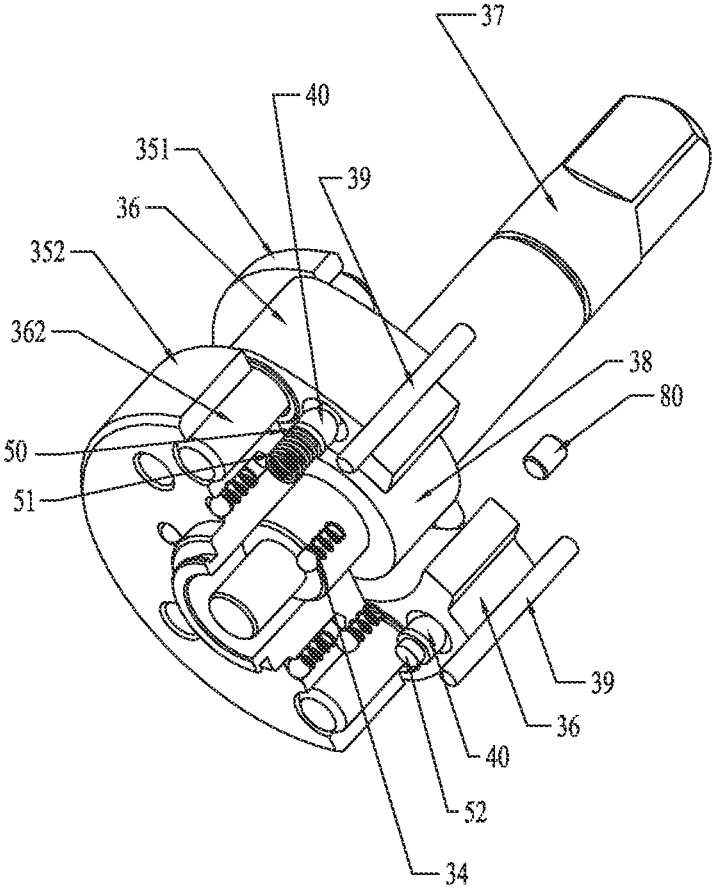
FIG. 8 is a schematic view of the structure shown in FIG. 6, wherein the rotatable base is partially sectioned.
Figure 9:
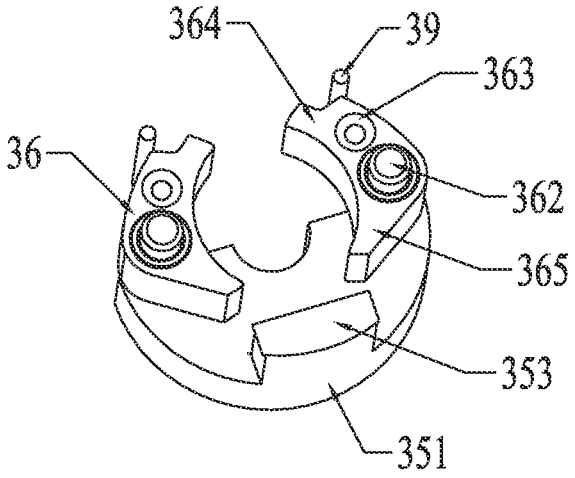
FIG. 9 is a schematic view of the structure shown in FIG. 6, wherein the rotatable base is partially sectioned in another manner.
Figure 10:
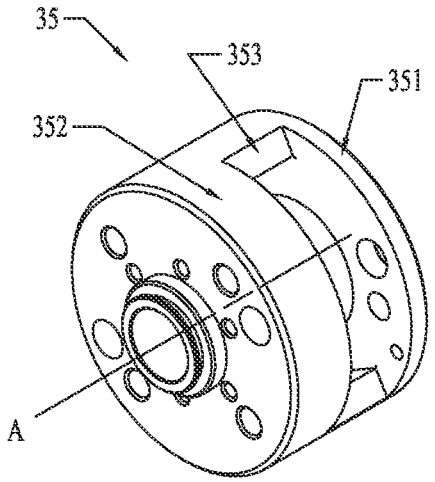
FIG. 10 is a schematic structural perspective view of the rotatable base in the tool shown in FIG. 1.
Figure 11:
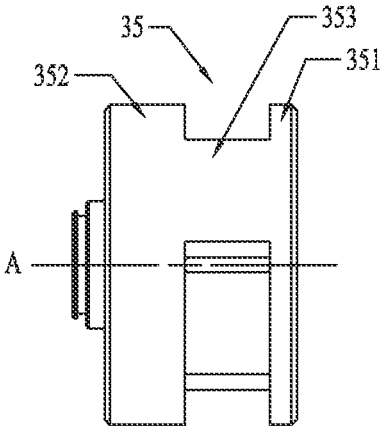
FIG. 11 is a schematic plan structural view (as viewed in a radial direction) of the rotatable base in the tool shown in FIG. 1.
Figure 12:
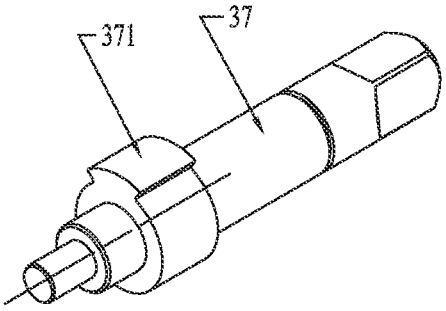
FIG. 12 is a schematic structural perspective view of an exemplary output shaft in the tool as shown in FIG. 1.

Therefore, as a preferred solution, referring to FIG. 5, a clutch assembly 34 is employed between the transmission member 33 and the rotatable base 35 to transfer the torque. Specifically, the clutch assembly 34 comprises: a clutch member 341 and a clutch elastic member 342. The transmission member 33 is formed with a transmission end face 332 facing towards the rotatable base 35. The transmission end face 332 is formed with more than two torque grooves **332*a* uniformly distributed in the circumferential direction. Correspondingly an end face of the rotatable base 35 facing towards the transmission member 33 is provided with at least a receiving groove 350 corresponding to the torque groove 332*a* to receive the clutch member 341 and the clutch elastic member 342. The clutch member 341 is biased by the clutch elastic member 342 towards the torque groove 332*a*, and when the torque groove 332***a* is aligned with the receiving groove 350, the clutch member 341 will be partially embedded into the torque groove 332*a* and partially remained in the receiving groove 350 and, as a result, a torque transmission can be performed between the transmission member 33 and the rotatable base 35. At this moment, the clutch assembly 34 is in a first state. Generally, when there is no impact, the clutch assembly 34 may remain in the first state; when the rotatable base 35 rotates reversely due to an impact, the transmission member 33 rotates positively, if a component of a force generated by them and applied to the clutch member 341 in a biasing direction of the clutch elastic member 342 is sufficient to overcome a biasing force of the clutch elastic member 342, the clutch member 341 retracts into the receiving groove 350, whereupon the clutch assembly 34 is in a second state. At this time, the rotatable base 35 disengages from the transmission member 33 and rotates reversely by itself, and the transmission member 33 will not transfer the counter-acting force of the rotatable base 35 to the motor 20. After completion of the impact of the rotatable base 35, along with the rotation of the transmission member 33, the clutch member 341 can be aligned with the torque groove 332*a* again to allow the clutch assembly 34 to restore to the first state and, as a result, the transmission member 33 and the rotatable base 35 achieve torque transmission again. Specifically, the clutch member 341 may employ a steel ball as shown in FIG. 5, and the clutch elastic member 342 may employ a spiral spring as shown in FIG. 5.

Noticeably, "biasing" mentioned in the present application means that a certain part enables another part to have a tendency of moving in a certain direction. Such action may be either direct or indirect, and it may be understood as an elastic member acting upon another member or a magnetic member acting upon another member, but not limited to these examples only.

Referring to FIGS. 6-16, in order to achieve positive rotation impact and reverse rotation impact, two impact blocks 36 are pivotally connected to the rotatable base 35, and rotation axes of the two impact blocks 36 are both parallel to the first axis A.

As a preferred solution, the rotatable base 35 comprises: a front frame 351, a base 352 and at least a connecting pillar 353 disposed there between to connect them as a whole.

The rotatable base 35 may be regarded as a rotation body. A section thereof in an axial direction is selected and radially hollowed to form a space for receiving the impact block 36, and two sides of the hollowed structure are respectively the front frame 351 and the base 352. The connecting pillar 353 is formed by a portion not removed at the hollowed structure.

The impact block 36 is provided with a rotation shaft pin hole 361 in which a rotation shaft pin 362 is arranged. The impact block 36 is pivotally connected with the rotatable base 35 mainly through the rotation shaft pin 362. An end of the rotation shaft pin 362 is disposed in the front frame 351, and the other end is disposed in the base 352. Therefore, with the arrangement of the front frame 351 and the base 352, the rotation shaft pin 362 can be well fixed.

The front frame 351 and the base 352 are both provided at their rotation centers with a through hole structure, namely a front through hole 351*a* and a rear through hole 352*a* respectively, wherein a portion of the output member 32 extends into the rear through hole 352*a* and this portion forms a receiving slot. One end of the output shaft 37 is disposed in the receiving slot to achieve a clearance fit. A bearing 38 is disposed in the front through hole 351*a*, and the output shaft 37 passes through the bearing 38 and is rotatably connected with the rotatable base 35 via the bearing 38. The front through hole 351*a* and the rear through hole 352*a* function to receive a member that can support the output shaft 37 and rotate relative thereto or a portion of the member so that the output shaft 37 serves as an independently rotatable member when not subjected to an impact, and will not be interfered by any member other than the impact block 36.

Certainly, the rotatable base 35 may employ an open type structure only having the base 352, but such structure does not achieve good fixation for the rotation shaft pin as stated in the previous solution, nor does it achieve excellent support for the output shaft 37.

Preferably, in terms of dimension, an axial dimension of the base 352 should be greater than an axial dimension of the front frame 351.

The electric tool 100 further comprises a locking member 40, a biasing assembly 50, a regulating assembly 60 and a control assembly 70. Preferably, the locking member 40 is a spherical member, the biasing assembly 50 comprises: a spiral spring 51 serving as an elastic element and a cushion 52. To arrange the locking member 40 and the biasing assembly 50, the base 352 is provided with two locking through holes 352*b*. The locking member 40 is disposed in the locking through hole 352*b*, and the spiral spring 51 and cushion 52 are disposed in the locking through hole 352*b*. The cushion 52 is disposed between the spiral spring 51 and the locking member 40. Referring to FIGS. 17-20, the regulating assembly 60 comprises: a press plate 61 which is an annular plate and whose plate surface facing towards the rotatable base 35 is provided with press rods 611, 612, the press rods 611 partially extends into the locking through hole 352*b* of the rotatable base 35 to make a slip connection, the sliding direction is parallel to the first axis A; and meanwhile, due to the action of the press rods 611, 612, the press plate 61 can synchronously rotate with the rotatable base 35. One end of the spiral spring 51 abuts against the cushion 52, the other end thereof abuts against a press rod 611 of a press plate 61 in a regulating assembly 60. An axial position of the press rod 611 is invariable in the absence of regulation, the cushion 52 contacts with the locking member 40 to transfer the biasing action of the spiral spring 51 to the locking member 40 to enable the locking member 40 to move towards the impact block 36. When a locking slot 363 provided on the impact block 36 aligns with the locking through hole 352*b*, the locking member 40 can be partially embedded therein so as to fix the position of the impact block 36 to prevent it from rotating. When the rotating speed of the rotatable base 35 is sufficient, the centrifugal force of the impact block 36 increases, and when it reaches a certain threshold, its acting force on the locking member 40 allows the locking member 40 to retract into the locking through hole 352*b* against the spiral spring 51 and the locking member 40 does not lock the impact block 36 any further.

Figure 13:
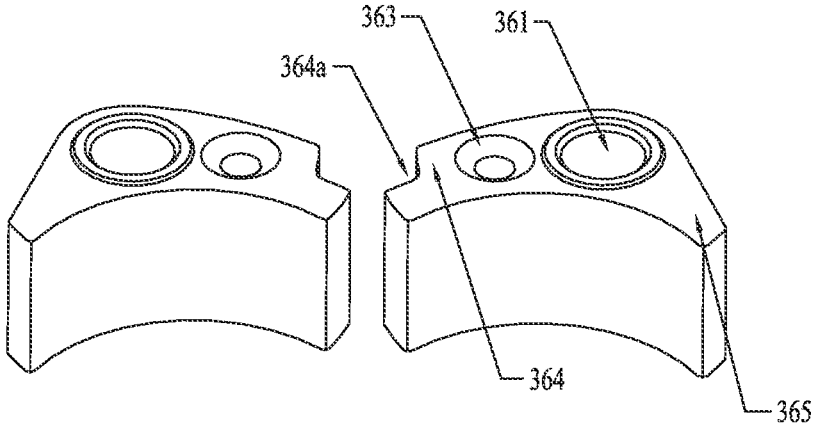
FIG. 13 is a schematic structural perspective view of an exemplary impact block in the tool as shown in FIG. 1.
Figure 14:
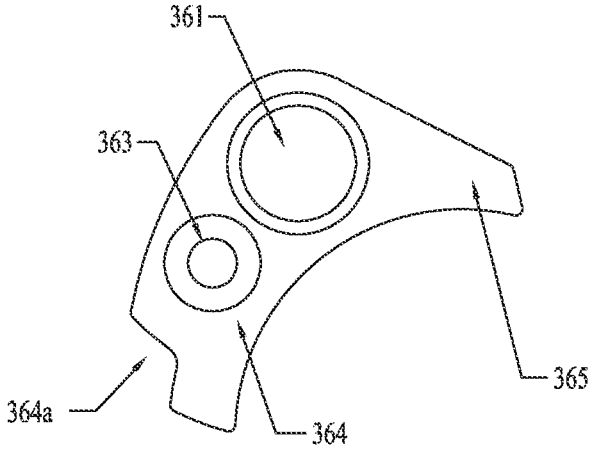
FIG. 14 is a schematic plan structural view (as viewed in an axial direction) of the impact block in the tool shown in FIG. 1.

The two impact blocks 36 are separate elements that can be in mirror symmetry. "Separate elements that can be in mirror symmetry" here means that the two impact blocks 36 are different, but they are a mirror structure for each other as shown in FIG. 13, in a relation similar to that between left hand and right hand.

The two impact blocks 36 are provided in a mirror manner on both sides of a first plane B respectively, and the first plane B is a plane where the first axis A lies.

As for one impact block 36, it is divided, with the rotation shaft pin hole as a boundary, into a portion with a larger mass and a portion with a lesser mass. When the rotatable base 35 rotates about the first axis A, under the action of the centrifugal force, the impact block 36 generates a torque allowing it to rotate due to different masses of the two portions. The portion with the larger mass rotates outwardly away from the first axis A, whereas the portion with lesser mass rotates inwardly towards the first axis A; therefore, the portion with lesser mass can impact on an impact protrusion 371 formed on the output shaft 37. For ease of description, the portion with larger mass is called a locking portion 364 whereas the portion with lesser mass is called an impact portion 365.

Generally, the impact blocks 36 are made of the same material, so the locking portion 364 is larger in size and therefore the locking slot 363 is formed in the locking portion 364.

As a preferred solution, in order to prevent the locking portion 364 from being thrown out of the range of the rotatable base 35 and from affecting other parts, the rotatable base 35 is fixed with a limiting pin 39 which is disposed on a path through which the locking portion 364 pivots. Furthermore, since the locking portion 364 has a larger size, in order to make the impact portion 365 pivot in an angle sufficient to enable itself to contact the output shaft 37, the locking portion 364 is formed with a recess 364*a* so that the locking portion 364 pivots with a larger angle to contact with the limiting pin 39.

The output shaft 37 is formed with a transmission projection 371 which radially projects and is positioned axially corresponding to the axial position of the impact block 36. The transmission projection 371 is shaped approximately as a sector as viewed along the axial direction, an end of the impact portion 365 is formed in a shape adapted for matching with a root of the transmission projection 371, namely, both lateral sides of the sector.

Figure 15:
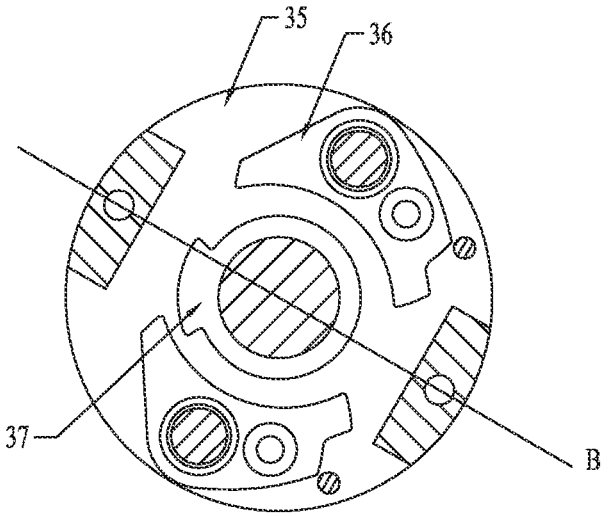
FIG. 15 is a schematic cross-sectional structural view (with a section perpendicular to axial direction) in a state that the impact block in the tool shown in FIG. 1 does not impact on the output shaft.
Figure 16:
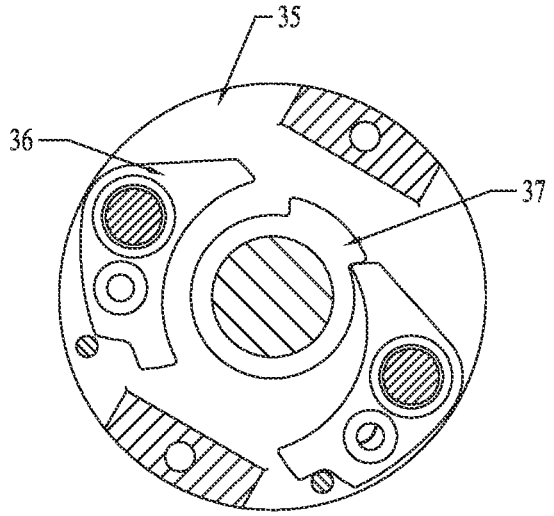
FIG. 16 is a schematic cross-sectional structural view (with a section perpendicular to axial direction) in a state that the impact block in the tool shown in FIG. 1 impacts on the output shaft.
Figure 17:
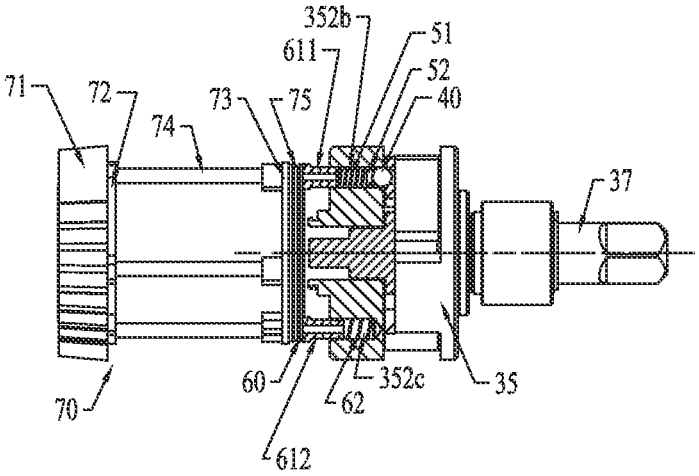
FIG. 17 is a schematic structural view of another portion of the tool in FIG. 1.
Figure 18:
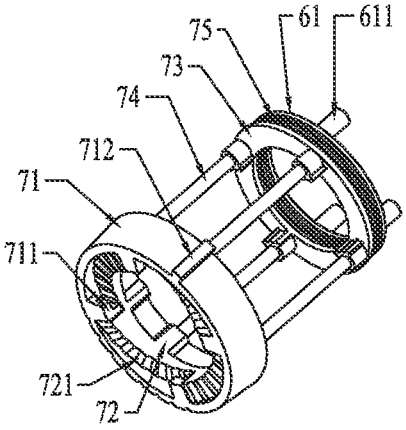
FIG. 18 is a schematic structural view of a whole consisting of an exemplary regulating assembly and an exemplary control assembly in the tool shown in FIG. 1.
Figure 19:
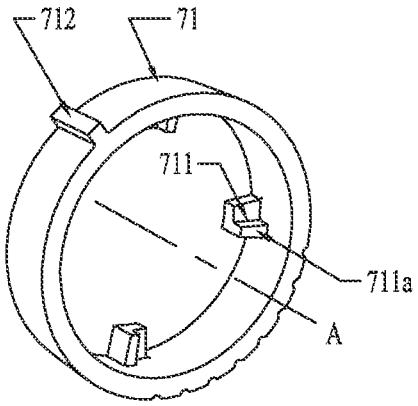
FIG. 19 is a schematic structural view of an exemplary operation ring in the tool shown in FIG. 1.
Figure 20:
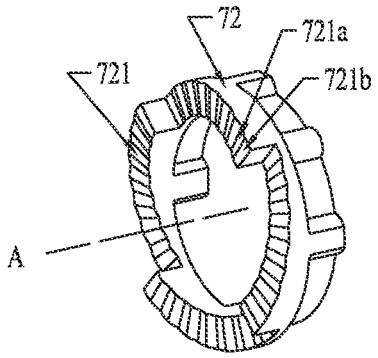
FIG. 20 is a schematic structural view of an exemplary inner ring in the tool shown in FIG. 1.

FIG. 15 shows a state in which the impact block 36 is locked, and FIG. 16 shows a state when the impact block 36 is released and impacts on the output shaft 37.

Generally, the number of the press rods 611, 612 should correspond to the number of the locking through holes 352*b*. However, since the press rods 611, 612 are also responsible for the transfer of torque, structural strength provided by the two press rods 611 is limited. Furthermore, since the press plate 61 is an annular structure, if there are only two symmetrical press rods 611, the press plate 61 is subjected to an axial acting force only in two positions; if the press plate 61 does not have a sufficient rigidity, it can be damaged.

Hence, as a preferred solution, the number of press rods 611, 612 is four, and the press rods 611, 612 are uniformly distributed on a circumference of the press plate 61, wherein two press rods 611 partially extend into the locking through hole 352*b*. The two press rods 611 are provided apart from the remaining two press rods 612, and the remaining two press rods 612 extend into blind holes 352*c* formed on the base 352. A spiral spring 62 is also disposed in each blind hole 352*c* and functions to balance the action of the spiral spring 51 in the biasing assembly 50 so that the press plate 61 can receive a force evenly.

As can be seen from the above, by axially adjusting the position of the press plate 61, a biasing degree exerted by the biasing assembly 50 to the locking member can be adjusted so that the impact block 36 can be released at different rotation speeds of the rotatable base 35 and contact with the output shaft 37 to achieve a transmission. It is appreciated that the torque of the output shaft 37 depends on the rotation speed of the impact block 36 upon impact, namely, the rotation speed of the rotatable base 35 at that time. Therefore, adjustment of the torque output by the output shaft 37 may be achieved by adjusting the position of the press plate 61 in the above solution.

Based on the same idea and based on the above solution, the elastic member (spiral spring 51) in the biasing assembly 50 may be replaced with a magnetic member fixed at an end of the press rod 611, and the locking member 40 employs a steel ball. At this time, the press plate 611 is adjusted to achieve the above function through changing of a distance between the magnetic member and the steel ball.

As another preferred solution, the biasing assembly comprises: an electromagnetic body capable of attracting or expelling the locking member. The electromagnetic body may be disposed in the locking through hole 352*b*, or outside the rotatable base 35. The regulating assembly comprises: a power supply module for powering the electromagnetic body, and the control assembly comprises: a magnetic control circuit board which can control the power supply module. When this solution is employed, the magnetic control circuit board controls, when the rotatable base 35 reaches a threshold, the power supply module to allow the electromagnetic body to attract the locking member so as to make it move away from the impact block 36 and release the locking; when the torque needs to be transferred, the electromagnetic body expels the locking member to allow it to lock the impact block 36; since the greater the rotation speed of the rotatable base 35 the more difficult it is for the locking member to remain in the locked state, the magnetic control circuit board may detect the rotation speed according to the current of the motor 20, and correspondingly adjust an expelling force of the electromagnetic body by controlling the power supply module.

Figure 2:
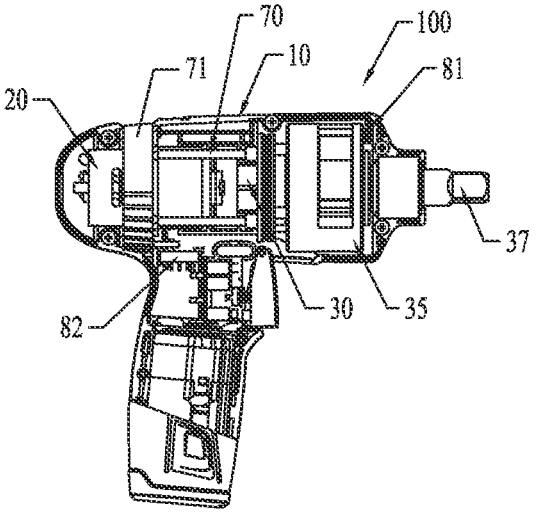
FIG. 2 is a schematic view of the internal structure of the tool as shown in FIG. 1.
Figure 3:
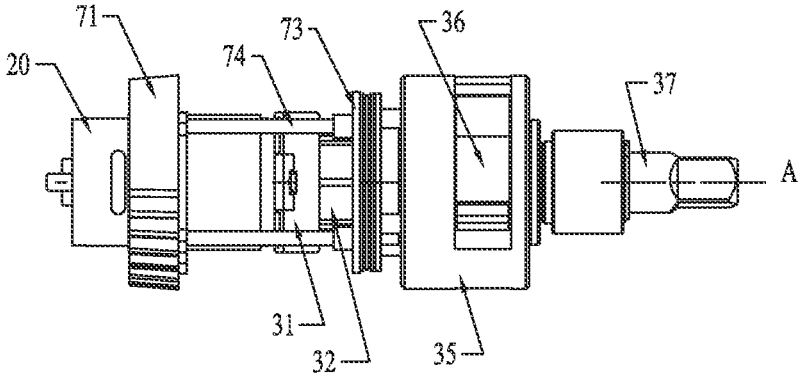
FIG. 3 is a schematic view of partial structures of the tool as shown in FIG. 1.
Figure 4:
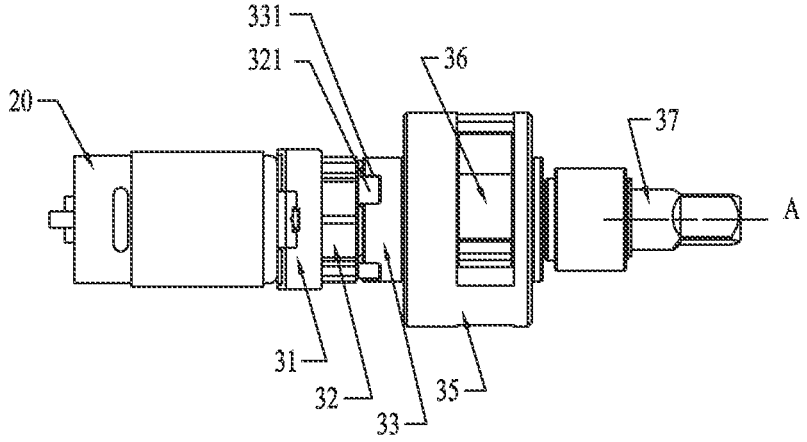
FIG. 4 is a structural schematic view of an exemplary transmission mechanism in the tool as shown in FIG. 1.

To help the user to more conveniently control the press plate 61 in the regulating assembly 60 as show in FIGS. 17 to 20, the control assembly 70 comprises: an operation ring 71 configured to rotate a preset angle about the first axis A, an inner ring 72 configured to move in a direction parallel to the first axis A when the operation ring 71 rotates, a pushing plate 73 which is rotatably connected to the press plate 61 with the first axis A as an axis, and at least a link 74 disposed between the inner ring 72 and the pushing plate 73. The operation ring 71 is disposed at an outer periphery of the inner ring 72 and its inside is provided with more than one inner edge protrusion 711, and the outside of the inner ring 72 is provided with an inclined step 721 for matching with the inner edge protrusion 711. As shown in FIG. 1 and FIG. 2, a portion of the operation ring 71 is exposed out of the housing 10 through a notch provided on the housing 10 so that the user can operate it.

A planar bearing 75 is disposed between the pushing plate 73 and the press plate 61 in a way that when the press plate 61 rotates, the pushing plate 73 does not rotate along with it, and both ends of the link 74 are respectively connected to the inner ring 72 and the pushing plate 73 to transfer a pushing force.

The spiral spring 51 in the biasing assembly 50 has a certain dimension itself, the dimension of the locking through hole 352*b* should not be too large, and only a portion of the operation ring 71 should be exposed out of the housing 10. Therefore, in fact, the rotation angle of the operating ring 71 should be limited. An outer edge of the operation ring 71 is provided with a protuberance 712 which, by catching the housing 10, limits a maximum rotation position of the operating ring 71 and meanwhile facilitates the user's operation.

The inclined step 721 of the inner ring 72 may be provided with a plurality of segments uniformly distributed along the circumferential direction, a radian occupied by each segment should be identical with a maximum rotation angle of the operation ring 71, and correspondingly the inner edge protrusion 711 of the operation ring 71 is applicable with it.

Reference may be made to FIGS. 17 to 20 for a specific structure of the inclined step 712 and inner edge protrusion 711. If the axial direction is taken as a vertical direction, the inclined step 721 may be regarded as a structure of a rotation ladder. Each step unit comprises a step surface 721*a* obliquely intersecting with the axial direction and a step surface 721*b* perpendicular to the axial direction. In other words, during the inclined step 721 being formed in the circumference direction, it has a plurality of step surfaces in different axial positions, with step surface 721*a* obliquely intersecting with the axial direction (or partially obliquely intersecting, the same hereinafter) alternating with the step surface 721*b* perpendicular to the axial direction (or partially perpendicular, the same hereinafter). The step surfaces 721*a* obliquely intersecting with the axial direction are used for transition, and the step surfaces 721*b* perpendicular to the axial direction are used for positioning a stage. Correspondingly, the inner edge protrusion 711 is formed with a positioning face 711*a* perpendicular (or partially perpendicular, the same hereinafter) to the axial direction. When the operation ring 71 rotates, the positioning face 711*a* passes by, from one step surface 721*b* perpendicular to the axial direction, a step surface 721*a* obliquely intersecting with the axial direction and reaches next step surface 721*b* perpendicular to the axial direction to achieve a stage adjustment. Since different step surfaces 721*b* perpendicular to the axial direction have different axial positions whereas the operation ring 71 has a fixed axial position, the axial position of the inner ring 72 changes.

Certainly, the positioning face 711*a*, and the step surfaces 721*a*, 721*b* may take other forms so long as stage shifting can be achieved.

Surely, there are many structures for implementing a conversion from rotation to linear movement, which all result from combinations of general technical means under the suggestion of the present solution, and which will not be detailed here.

Noticeably, the above solution can achieve control of the rotation speed at the moment when the impact block 36 is unlocked and thrown out, and thereby achieve control of the torque output of the output shaft 37. However, it is appreciated that the impact block 36, after being released, does not impact immediately, the impact block 36's own rotation requires a very short time interval. If the current of the motor 20 is not controlled at this time to further increase its rotation speed, the outputted torque upon occurrence of impact will be greater than the preset torque. Therefore, in order to more rigidly control the torque output, as a preferred solution, a speed detection means capable of measuring the rotation speed of the rotatable base 35 is provided and a control means is also provided to control the rotation speed. When the rotation speed reaches the rotation speed threshold at which the impact block 36 is released, the control means controls the motor 20 to make its speed steady to achieve precise control of the torque.

Specifically, as shown in FIGS. 2, 6, 8 and 9, more than one speed counting element 80 is disposed on the rotatable base 35, and in the housing 10 is provided a detecting means 81 capable of detecting the speed counting element 80, and meanwhile provided a main control circuit board 82 capable of receiving rotation speed data fed back from the detecting means 81 and controlling rotation speed of the motor 20 when the rotation speed reaches a preset value.

The speed counting element 80 is disposed in a groove provided in the front frame 351 of the rotatable base 35, the detecting means 81 is correspondingly provided at a location in the housing 10 capable of detecting the speed counting element 80, and furthermore, the speed counting element 80 is a magnetic element and the detecting means 81 is a Hall element.

The above illustrates and describes basic principles, main features and advantages of an exemplary electric tool. Those skilled in the art should appreciate that the described embodiments by no means limit the present invention. All technical solutions obtained by employing equivalent substitutes or equivalent variations fall within the protection scope of the invention that is defined by the claims that follow.

What is claimed is:

1. An electric tool for outputting torque, comprising:

a housing and a motor disposed in the housing;

a rotatable base configured to be driven by the motor to rotate about a first axis;

at least one impact block pivotally connected to the rotatable base;

an output shaft rotatably connected in the housing and configured to rotate about the first axis under intermittent impact of the at least one impact block;

a locking member which, when at a first position, locks the at least one impact block to prevent the at least one impact block from impacting on the output shaft and which, when at a second position, releases the impact block to allow it to rotate freely;

a biasing assembly for biasing the locking member to the first position;

a regulating assembly for regulating a biasing degree exerted by the biasing assembly on the locking member;

a transmission member driven by the motor to rotate about the first axis;

a clutch assembly transmitting motion between the transmission member and the rotatable base when in a first state and releasing the transmission member when in a second state; and a control assembly operable by the user from outside the housing to control the regulating assembly;

wherein the locking member is disposed at least partially in the rotatable base.

2. The electric tool for outputting torque according to claim 1, wherein the transmission member is formed with a transmission end face on one side facing towards the rotatable base, wherein the transmission end face is formed with more than two torque grooves uniformly distributed in the circumferential direction; and an end face of the rotatable base facing towards the transmission member is provided with at least a receiving groove corresponding to the torque groove; and the clutch assembly comprises: a clutch member movably disposed in the receiving groove and able to be partially embedded into the torque groove, and a clutch elastic member disposed in the receiving groove and biasing the clutch member towards the transmission member.

3. The electric tool for outputting torque according to claim 1, wherein the impact block is provided with a locking recess, and the rotatable base is provided with a locking through hole which receives the locking member to allow it to move in a direction parallel to the first axis, to be partially embedded into the locking recess when at the first position which is adjacent to the impact block so as to block rotation of the impact block, and to retreat out of the locking recess when at the second position which is away from the impact block.

4. The electric tool for outputting torque according to claim 3, wherein the rotatable base comprises: a front frame, a base and at least a connecting pillar disposed there between and connecting them as a whole, the impact block being disposed between the front frame and the base.

5. The electric tool for outputting torque according to claim 4, wherein the base is disposed on a side adjacent to the biasing assembly, and the front frame is disposed on a side adjacent to the output shaft, the front frame, the connecting pillar and the base are distributed in turn in a direction parallel to the first axis; and the base is provided with the locking through hole.

6. The electric tool for outputting torque according to claim 3, wherein the biasing assembly comprises an elastic element or a magnetic body disposed in the locking through hole and configured to bias the locking member towards the impact block, and the regulating assembly comprises: a press plate slidably connected to the rotatable base in a direction parallel to the first axis and configured to rotate synchronously therewith; wherein the press plate is formed with at least a press rod; the press rod partially extending into the locking through hole and contacting with one end of the elastic element, the other end of the elastic element contacting with the locking member, or the press rod partially extending into the locking through hole and being fixed with the magnetic body at its end.

7. The electric tool for outputting torque according to claim 6, wherein the control assembly comprises: an operation ring configured to rotate a preset angle about the first axis, an inner ring configured to move in a direction parallel to the first axis when the operation ring rotates, a pushing plate rotatably connected to the press plate with the first axis as an axis, and at least a link disposed between the inner ring and the pushing plate.

8. The electric tool for outputting torque according to claim 7, wherein the operation ring is disposed at outer periphery of the inner ring and an inside surface of the inner ring is provided with more than one inner edge protrusion, and an outside surface of the inner ring is provided with an inclined step matching with the inner edge protrusion.

9. The electric tool for outputting torque according to claim 1, wherein a rotation axis of the impact block is parallel to the first axis.

10. The electric tool for outputting torque according to claim 9, comprising a pair of impact blocks, the pair of impact blocks being separate elements that are in mirror symmetry and respectively provided on both sides of a first plane where the first axis lies.

11. The electric tool for outputting torque according to claim 1, wherein the biasing assembly comprises an electromagnetic body capable of attracting or expelling the locking member, and the regulating assembly comprises a power supply module for powering the electromagnetic body, and the control assembly comprises a magnetic control circuit board for controlling the power supply module.

12. The electric tool for outputting torque according to claim 1, wherein the electric tool further comprises a speed counting element fixedly disposed on the rotatable base, and a detecting means for detecting a rotation speed of the speed counting element, the detecting assembly being disposed in the housing.

13. The electric tool for outputting torque according to claim 12, wherein the electric tool further comprises a main control circuit board for receiving rotation speed data fed back from the detecting means and for controlling rotation speed of the motor when a rotation speed reaches a preset value.

* * * * *